US006401590B1

(12) United States Patent
Coakley et al.

(10) Patent No.: US 6,401,590 B1
(45) Date of Patent: Jun. 11, 2002

(54) EXHAUST BLOCKAGE SYSTEM FOR ENGINE SHUT DOWN

(75) Inventors: David B. Coakley, Hyattsville; John W. Johnston, Germantown; Vincent J. Castelli, Severna Park, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/621,669

(22) Filed: Jul. 24, 2000

(51) Int. Cl.[7] ..... F41F 5/00
(52) U.S. Cl. ..... 89/1.11; 180/309
(58) Field of Search ..... 89/1.11; 169/36; 440/88, 89; 701/36; 70/168, 256; 180/309

(56) References Cited

U.S. PATENT DOCUMENTS 4,683,735 A * 8/1987 Magrobi
4,696,368 A * 9/1987 Hummel et al.
5,052,204 A * 10/1991 Millar
5,444,102 A * 8/1995 Nimitz et al.
5,501,284 A * 3/1996 Clodfelter et al.
5,590,717 A * 1/1997 McBay et al.
5,778,984 A * 7/1998 Suwa
5,839,081 A * 11/1998 Joao et al.
5,848,650 A * 12/1998 Brady
5,867,987 A * 2/1999 Halimi et al.
6,261,140 B1 * 7/2001 Yoshida et al.

* cited by examiner

*Primary Examiner*—Michael J. Carone
*Assistant Examiner*—Troy L. Chambers
(74) *Attorney, Agent, or Firm*—Jacob Shuster

(57) ABSTRACT

A flow blocking device is lowered by cable from a helicopter for insertion into the exhaust gas stack of a fuel burning combustion engine propelling a marine vessel under full engine speed. The wall of the exhaust stack are engaged upon entry of the flow blocking device to insure its retention within the exhaust stack and to initiate in sequence ejection of cooling water into the outflow of the exhaust gas followed by pressurized gas expansion of a flexible hose portion of the flow blocking device into sealing contact with the walls of the exhaust stack to stop exhaust gas outflow and cause back pressure build up to a high engine shut down level.

7 Claims, 2 Drawing Sheets

EXHAUST BLOCKAGE SYSTEM FOR ENGINE SHUT DOWN

The present invention relates generally to shut down of propulsion engines of marine vessels during seaway travel.

BACKGROUND OF THE INVENTION

Devices for plugging of tubular pipes to block flow of fluids therethrough, are generally well known. It is also well known in the art, that build up of exhaust back pressure to certain high levels in fuel burning combustion engines, will cause engine shut down. It is an important object of the present invention to produce such engine shut down without engine damage under high temperature and full engine speed conditions by exhaust gas flow blockage to cause sufficient back-up pressure build-up.

SUMMARY OF THE INVENTION

In accordance with the present invention, engine shut down by build up of exhaust back-up pressure is effected by insertion of a flow blocking device into an engine exhaust stack during outflow of the exhaust gas therefrom under full engine speed. Pursuant to certain embodiments of the invention, such flow blocking device is inserted by cable lowering from a helicopter into the exhaust stack associated with the fuel burning propulsion engine of a marine vessel undergoing seaway travel at full engine speed. Entry of the flow blocking device into the exhaust stack stops outflow of the exhaust gas to cause back pressure build-up therein. The requisite duration for such flow blocking action is insured according to one embodiment by mechanical means after entry of the flow blocking device, to prevent its ejection from the stack by the back pressure build-up therein. Also, according to other embodiments a sequence of events is initiated after the flow blocking device reaches a lowermost position within the exhaust stack to perform the flow blocking function. Such events may include water cooling of the exhaust gas to low temperature conditions within the exhaust stack under which a flexible portion of the flow blocking device is inflated or expanded into contact with the stack for pressurized sealing there to block exhaust outflow until engine shut down occurs.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
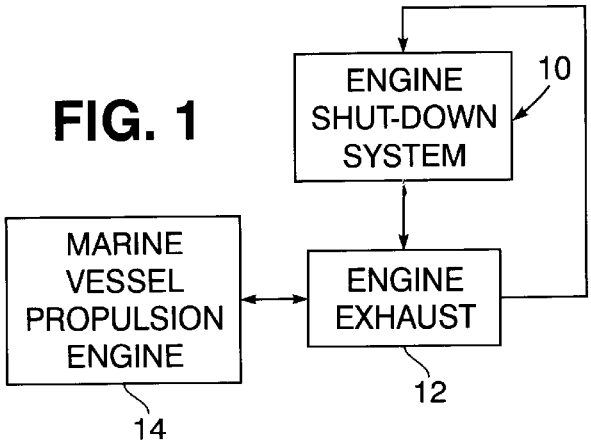
FIG. 1 is a block diagram depicting the environment of the present invention.

Referring now to the drawing in detail, FIG. 1 diagrams a system 10 for shut down of a full burning combustion engine 12 utilized for propulsion of a marine vessel or ship. Engine shut down is effected without damage by blockage of the engine exhaust 14, causing build up of engine back pressure to a high shut down level. Such blockage of engine exhaust is performed with respect to the propulsion engine 12 of a marine vessel while underway at sea, by blockage of its exhaust 14 having an exhaust stack 16 associated therewith as shown in FIG. 2.

Figure 2:
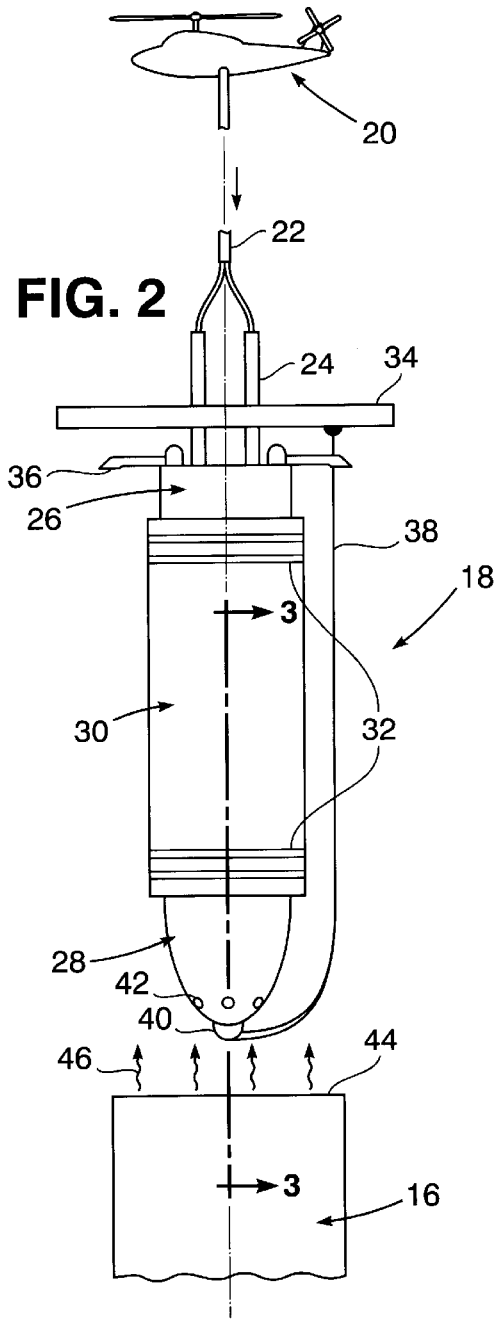
FIG. 2 is a side elevation view of an exhaust flow blocking device in accordance with one embodiment, being lowered into an engine exhaust stack.

With continued reference to FIG. 2, the engine shut down system 10 of the present invention involves lowering of an exhaust flow blocking device 18, dimensioned to fit into the exhaust stack 16, while the marine vessel is underway. The device 18 is accordingly suspended from a helicopter 20 for such purpose by a cable 22 connected at its lower end to a pair of slide-up attachment brackets 24 secured to the upper end of a cylindrical gas pressure canister 26 associated with the device 18. The canister 26 is held assembled in axial relationship to a nose cone 28 by a tubular flexible hose 30 clamped adjacent its upper and lower axial ends to the canister 26 and the nose cone 28 by pairs of bands 32 as shown in FIG. 2. Also associated with the device 18 is a cross-bar 34 slidably mounted on the attachment brackets 24. On the upper end of the canister 26 several radially projecting pawls 36 are mounted. Secured to the underside of the cross-bar 34 is the upper end of an actuator cable 38, the lower end of which is attached to a valve trigger element 40 projecting from the lower tip end of the nose cone 28. The valve trigger element 40 when actuated through cable 38 as hereinafter explained, is operative to cause ejection of pressurized cooling liquid such as water from openings 42 in the nose cone 28, in close spaced surrounding relation to the tip end location of the valve trigger element 40. Thus, engine exhaust blockage is initiated by entry of the device 18 into the stack 16 at its upper rim formed by a top edge 44, from which exhaust gas 46 emerges during engine operation at full speed.

Figure 3:
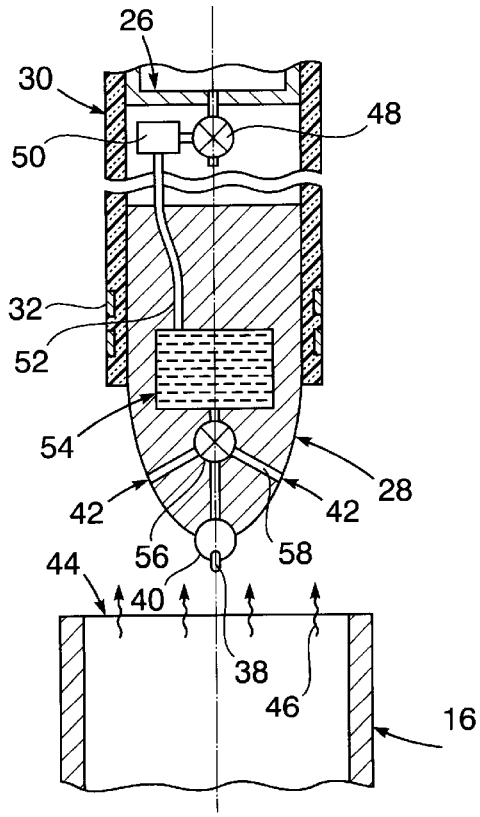
FIG. 3 is a partial section view taken substantially through a plane indicated by section line 3—3 in FIG. 2.

As shown in FIG. 3, the canister 26 filled with pressurized gas, such as nitrogen, has a normally closed gas valve 48 connected to its lower end from which pressurized gas may be ejected upon opening of the valve 48 into an expansion chamber enclosed by the hose 30 for expansion thereof from the contracted condition shown. The expansion chamber is formed within the hose 30 axially between the locations at which the hose is clamped by the bands 32 to the canister 26 and the nose cone 28. Such hose 30 is accordingly made of a suitable nonlinear orthotropic composite material composed of rubber and fibers, with the fibers layed-up so that the hose expands in diameter when internal gas pressure is applied thereto between 40 and 80 psi for example, upon opening of the valve 48. Associated with such valve 48 is a pressure responsive actuator 50 connected by tube 52 to the upper end of a pressurized cooling liquid tank 54 formed within the nose cone 28. The lower end of the tank 54 is connected to a normally closed valve 56 opened by actuation of the valve trigger element 40 through cable 38. Opening of the valve 56 accordingly supplies pressurized liquid such as water from tank 54 to galleries 58 from which the water is ejected from the nose cone openings 42.

Figure 4:
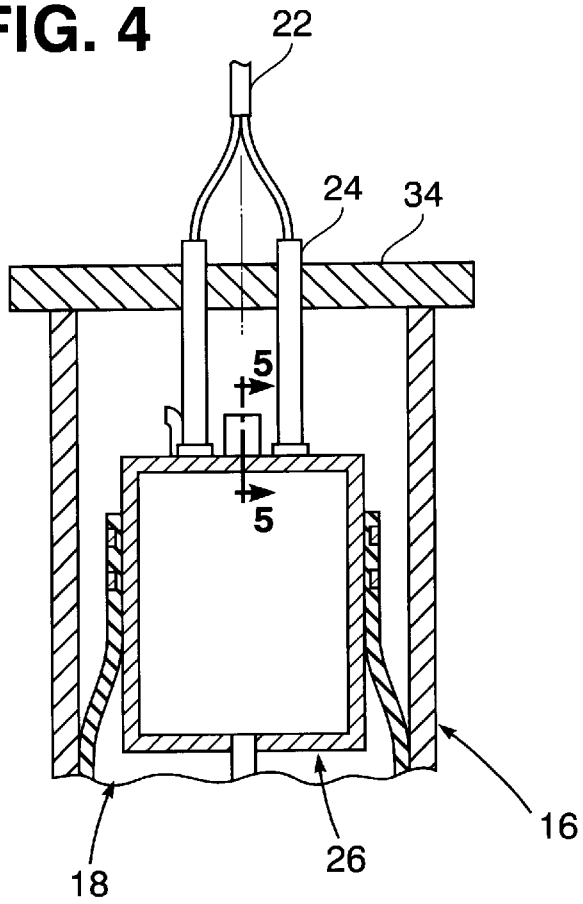
FIG. 4 is a partial section view of the exhaust flow blocking device shown in FIGS. 2 and 3, in a fully lowered position within the engine exhaust stack.

The valve 56 is opened by the trigger element 40 after the device 18 descends into exhaust stack 16 causing the cross-bar 34 to abut the upper stack edge 44 as shown in FIG. 4. The cross-bar 34 is thereby displaced upwardly relative to the device 18 as it continues to be lowered into the stack 16 until it reaches the position shown in FIG. 4, automatically exerting a pulling force through cable 38 on the valve trigger element 40 to initiate exhaust blockage of the stack 16. The pressurized water from tank 54 is thereby ejected from the nose cone 28 through openings 42 into the exhaust gas 46 for mixing therewith so as to be vaporized and cool the exhaust stream as well as the wall surfaces within the stack 16. Such cooling effect is related to the properties of the material of hose 30 so as to maintain most or all of its room temperature strength.

Figure 5:
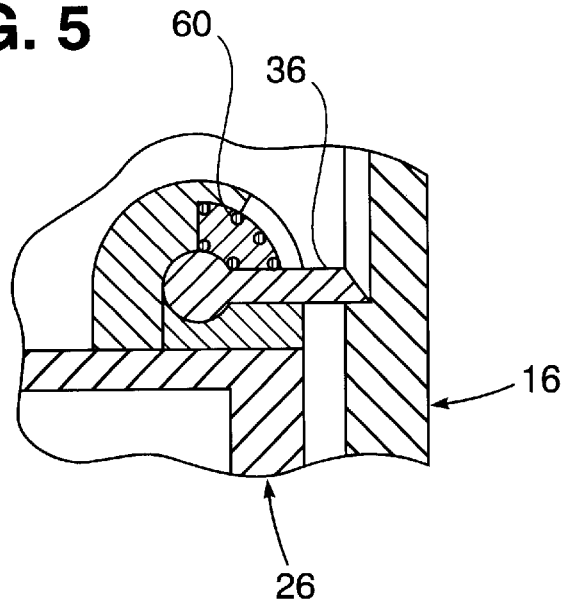
FIG. 5 is a partial section view taken substantially through a plane indicated by section line 5—5 in FIG. 4.

As the device 18 is being lowered into the stack 16, the pawls 36 make contact with the top edge 44 of the stack at its upper rim and are pushed radially inwardly against spring bias exerted for example by springs 60 shown in FIG. 5. Such spring bias maintains the pawls 36 in contact with the stack walls. Should the canister 26 be urged in an upward direction, the sharpened tips of the pawls 36 dig into the stack wall so as to prevent upward displacement of the device 18. Such upward urge could be imposed on the canister 26 by subsequently developed pressures therebelow within the stack 16.

As the cooling water leaves tank 54 for ejection into the emerging engine exhaust, the tank pressure drops. When such tank pressure drops below a preset value, it is sensed by valve actuator 50 to open gas valve 48 through which the pressurized gas from canister 26 fills the expansion chamber void inside of the hose 30 and then causes its expansion into sealing contact with the walls of the stack 16 as shown in FIG. 4. Exit of exhaust gas from the stack is then blocked by such sealing action of the hose 30 caused by the canister gas producing back pressure build up to a level causing shut down of the engine. The pawls 36 assist and/or insure retention of the device 18 within the stack 16 under the high level back pressure.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a fuel burning combustion engine having an exhaust stack from which outflow of exhaust gas occurs under full engine speed, a system for shut down of engine operation comprising: a flow blocking device; and cable means lowered from a helicopter for inserting said flow blocking device into the exhaust stack to stop said outflow of the exhaust gas therefrom under full engine speed; said flow blocking device including sealing means expanded into contact with the stack upon entry thereinto for blocking said outflow of the exhaust gas to effect build up of back pressure to an engine shut down level.

2. The combination as defined in claim 1, wherein said exhaust stack has an upper rim and said flow blocking device further includes: mechanical means engageable with said upper rim of the exhaust stack for preventing ejection of the flow blocking device therefrom by said build up of the back pressure.

3. The flow blocking device as defined in claim 2, further including: a nose cone having a source of pressurized cooling liquid therein; and valve means connected to said source for discharge of the pressurized cooling liquid from the nose cone into the exhaust gas within the stack in response to displacement of the flow blocking device to a lowermost position within the exhaust stack establishing cooled temperature conditions therein preceding operation of the sealing means.

4. The flow blocking device as defined in claim 3, wherein said sealing means includes a canister of pressurized gas; a flexible hose interconnecting the canister and the nose cone to form an expansion chamber therebetween; and pressure control means responsive to depressurization of said source of the pressurized cooling liquid for ejecting the pressurized gas from the canister into the expansion chamber to seal the exhaust stack after the cooled temperature conditions are established.

5. In combination with a fuel burning combustion engine having an exhaust stack from which outflow of exhaust gas occurs under full engine speed, a system for shut down of engine operation comprising: a flow blocking device; and means for inserting said flow blocking device into the exhaust stack to stop said outflow of the exhaust gas therefrom under full engine speed; said flow blocking device including: sealing means expanded into contact with the stack upon entry thereinto for blocking said outflow of the exhaust gas to effect build up of back pressure to an engine shut down level; a nose cone having a source of pressurized cooling liquid therein; and valve means connected to said source for discharge of the pressurized cooling liquid from the nose cone into the exhaust gas within the stack in response to displacement of the flow blocking device to a position within the exhaust stack establishing cooled temperature conditions therein preceding operation of the sealing means.

6. The flow blocking device as defined in claim 5, wherein said sealing means includes a canister of pressurized gas; a flexible hose interconnecting the canister and the nose cone to form an expansion chamber therebetween; and pressure control means responsive to depressurization of said source of the pressurized cooling liquid for ejecting the pressurized gas from the canister into the expansion chamber to seal the exhaust stack after the cooled temperature conditions are established.

7. In combination with a fuel burning combustion engine having an exhaust stack from which outflow of exhaust gas occurs under full engine speed, a system for shut down of engine operation comprising: a flow blocking device; and means for inserting said flow blocking device into the exhaust stack to stop said outflow of the exhaust gas therefrom under full engine speed; said flow blocking device including: sealing means expanded into contact with the stack upon entry thereinto for blocking said outflow of the exhaust gas to effect build up of back pressure to an engine shut down level; said sealing means including a canister of pressurized gas; a flexible hose interconnecting the canister and the nose cone to form an expansion chamber therebetween; and pressure control means for ejecting the pressurized gas from the canister into the expansion chamber to seal the exhaust stack.

* * * * *